US005115547A

United States Patent [19]

Rohde

[11] Patent Number: 5,115,547

[45] Date of Patent: May 26, 1992

[54] ARRANGEMENT FOR ROLLING HOT-ROLLED WIDE STRIPS

[75] Inventor: Wolfgang Rohde, Dormagen-Nievenheim, Fed. Rep. of Germany

[73] Assignee: SMS Schloemann-Siemag Aktiengesellschaft, Düsseldorf, Fed. Rep. of Germany

[21] Appl. No.: 645,270

[22] Filed: Jan. 18, 1991

[30] Foreign Application Priority Data

Jan. 18, 1990 [DE] Fed. Rep. of Germany ..... 4001288

[51] Int. Cl.[5] ..... B21B 1/46; B21B 13/22; B22D 11/14

[52] U.S. Cl. ..... 29/33 C; 29/527.6; 29/527.7; 72/202; 164/417

[58] Field of Search ..... 164/417, 476; 29/33 C, 29/527.6, 527.7; 72/202

[56] References Cited

U.S. PATENT DOCUMENTS 3,648,359 3/1972 Dennis ..... 29/527.7
4,918,803 4/1990 DiGiusto ..... 29/33 C
4,998,338 3/1991 Seidel et al. ..... 29/33 C X

FOREIGN PATENT DOCUMENTS 55-45530 3/1980 Japan ..... 29/527.7
57-121808 7/1982 Japan ..... 29/527.7
58-6701 1/1983 Japan ..... 164/417
60-96302 5/1985 Japan ..... 29/527.7
62-38704 2/1987 Japan ..... 29/527.7
62-54501 3/1987 Japan ..... 29/527.7

*Primary Examiner*—J. Reed Batten, Jr.
*Attorney, Agent, or Firm*—Toren, McGeady & Associates

[57] ABSTRACT

The arrangement includes three casting lines arranged in front of a finishing train. The casting line in the middle is in alignment with the finishing train. The thin slabs severed from the cast strands are conveyed to the finishing train with two ferries and which are combined longitudinal/transverse/longitudinal conveying systems. The thin slabs are conveyed by placing the two ferries alternatingly in alignment with two adjacent casting lines.

6 Claims, 1 Drawing Sheet

ARRANGEMENT FOR ROLLING HOT-ROLLED WIDE STRIPS

BACKGROUND OF THE INVENTION

1. Field of the Invention

The present invention relates to an arrangement for rolling hot-rolled wide strips from continuously cast thin slabs by means of a continuous finishing train.

2. Description of the Related Art

In newly developed production arrangements, the primary material used for the finishing train are continuously cast thin slabs which have a thickness of less than 70 mm, preferably 50 mm. The thin slabs are severed from a strand which is produced in a continuous casting machine. The strand is cut at a length which corresponds to the required coil weight for the finished hot-rolled wide strip.

For maintaining the necessary rolling temperature, the thin slabs are conveyed to a furnace, preferably a roller-bottom-type furnace, which can simultaneously be used as the conveying system from the continuous casting machine to the finishing train.

However, the casting speeds of continuous casting machines for continuously casting thin slabs which can be achieved today are relatively slow, so that the capacity of the subsequent continuous finishing train cannot be utilized. In fact, the feeding speed of the continuous finishing trains for hot-rolled wide strips are greater by approximately the factor 2 to 4 than the casting speed of casting machines suitable for continuously casting thin slabs.

Therefore, it has already been proposed to have two parallel continuous casting machines which cooperate with a continuous finishing train for hot-rolled Wide strips. In this arrangement, the thin slabs are alternatingly severed from each of the two cast strands and are subsequently conveyed to the hot-rolled wide strip finishing train for rolling. By means of two longitudinal/transverse/longitudinal conveying systems, or so-called ferries, the thin slabs are moved from the respective casting line and are placed in alignment with the hot-rolled wide strip finishing train, so that they can be pulled into the finishing train.

The above-described arrangement for rolling hot-rolled strips from continuously cast thin slabs results in a marked improvement with respect to the utilization of the finishing train and, thus, in an increase of the efficiency of the overall arrangement. However, an optimum utilization of the arrangement is still not possible.

SUMMARY OF THE INVENTION

It is the object of the present invention to further improve the utilization of the hot-rolled wide strip finishing train and, thus, to increase the efficiency of the overall arrangement.

In accordance with the present invention, the arrangement for rolling hot-rolled wide strips from continuously cast thin slabs includes three single-strand casting machines or casting lines which are arranged next to each other and in front of the finishing train. The casting machine or casting line in the middle is in alignment with the finishing train. Individual thin slabs can be severed from each of the three cast strands in a generally staggered sequence with respect to time. Two longitudinal/transverse/longitudinal conveying systems are arranged next to each other and following the casting machines or casting lines and in front of the finishing train. Each of the thin slabs severed from the cast strands can be placed on one of the two longitudinal/transverse/longitudinal conveying systems. The two longitudinal/transverse/longitudinal conveying systems can be placed at a distance next to each other which corresponds to the distance between two adjacent casting machines or casting lines. The two longitudinal/transverse/longitudinal conveying systems can be transversely moved synchronously together or coupled together through a distance which places one of the two longitudinal/transverse/longitudinal conveying systems in alignment with the casting machine or casting line in the middle as well as with the finishing train. Each thin slab can be conveyed to the finishing train from the longitudinal/transverse/longitudinal conveying system which is in alignment with the finishing train, while simultaneously the thin slab to be rolled subsequently can be conveyed onto the longitudinal/transverse/longitudinal conveying system which is in alignment with one of the casting machines or casting lines on the sides.

The arrangement according to the present invention for rolling hot-rolled wide strips from continuously cast slabs makes it possible to achieve substantially shorter cycle times for feeding the thin slabs to the hot-rolled wide strip finishing train, provided the following requirements are met,

- the time for feeding a thin slab severed from a cast strand into the longitudinal/transverse/longitudinal conveying system corresponds to the unloading time of such a thin slab from the longitudinal/transverse/longitudinal conveying system, and
- the rolling time for rolling a thin slab is always greater than the travel time of the longitudinal/transverse/longitudinal conveying system plus the feeding or unloading time.

In accordance with an important feature of the invention, for each casting machine or casting line there are arranged in front of the longitudinal/transverse/longitudinal conveying systems a furnace, an equalizing zone and a buffer zone, while the longitudinal/transverse/longitudinal conveying systems are followed by a receiving furnace which is arranged in front of and in alignment with the finishing train.

In accordance with another important feature, the longitudinal/transverse/longitudinal conveying systems are heatable ferries which may be furnaces which can be moved transversely and include a longitudinal conveying means, for example, roller-bottom-type furnaces.

The furnace, equalizing zone and buffer zone following each casting machine or casting line may also be formed by stationary roller-bottom-type furnaces.

Of course, the conveying speeds of all longitudinal conveying systems provided between the casting machines or casting lines and the hot-rolled wide strip finishing train can be controlled within a certain range determined by the casting speed in the individual casting machines or casting lines and by the entry speed of the hot-rolled wide strip finishing train, such that buffer times can be provided between the successive entry of two thin slabs into the finishing train which are sufficient for carrying out, for example, roll exchange operations. In this case, the buffer storage of thin slabs can be effected over the entire distance between the casting machines or casting lines and the hot-rolled wide strip finishing train because this entire distance, including the region of the longitudinal/transverse/longitudinal conveying systems or ferries, is formed by furnaces or heating units which maintain the rolling temperature.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
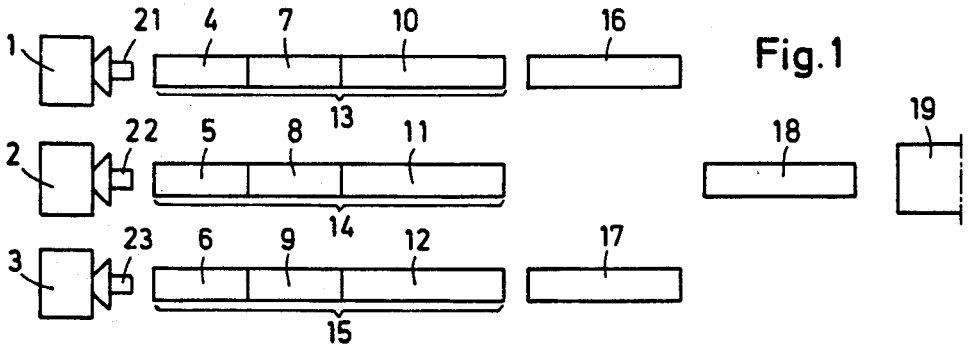
FIG. 1 is a schematic illustration of the arrangement for rolling hot-rolled wide strip according to the present invention, shown prior to the beginning of an operation.

As can be seen in all figures of the drawing, three single-strand casting machines or casting lines 1, 2 and 3 are provided next to each other.

A furnace 4, an equalizing zone 7 and a buffer zone 10 are arranged in alignment with and following the casting machine or casting line 1. A furnace 5, an equalizing zone 8 and a buffer zone 11 are arranged in alignment with and following the casting machine or casting line 2. Finally, a furnace 6, an equalizing zone 9 and a buffer zone 12 are provided in alignment with and following the casting machine or casting line 3.

Each furnace 4 or 5 or 6, including the respectively following equalizing zone 7 or 8 or 9 and buffer zone 10 or 11 or 12, is constructed as a roller-bottom-type furnace 13 or 14 or 15 which is continuous in longitudinal direction and practically forms a continuous longitudinal conveying means. Two so-called ferries are arranged following the three roller-bottom-type furnaces 13, 14, 15 or longitudinal conveying means. Each of the ferries may operate as a combined longitudinal/transverse/longitudinal conveying system.

A receiving furnace 18 is arranged following the ferries 16 and 17 and in alignment with the middle casting machine or middle casting line 2 and the middle roller-bottom-type furnace or longitudinal conveying system 14. The receiving furnace 18 is followed by and in alignment with the hot-rolled wide strip finishing train 19.

Each of the casting machines or casting lines 1, 2 and 3 is capable of continuously manufacturing a cast strand 21, 22 or 23 which is only schematically illustrated in the drawing.

Immediately following the casting machine or casting line 1, the cast strand 21 is divided into thin slabs 24 which gradually travel through the roller-bottom-type furnace 13 with the furnace zone 4, equalizing zone 7 and buffer zone 10. Corresponding thin slabs 25 are also severed from cast strand 22 immediately following the casting machine or casting line 2. The slabs 25 are fed into the roller-bottom-type furnace 14 where they travel through the furnace zone 5, the equalizing zone 8 and the buffer zone 11. Finally, immediately following the casting machine or casting line 3, the cast strand 23 is continuously divided into thin slabs 26 which reach the roller-bottom-type furnace 15 and travel successively through the furnace zone 6, the equalizing zone 9 and the buffer zone 12.

It will be assumed that, after beginning operation of the overall arrangement shown in FIG. 1 for rolling hot-rolled wide strip from continuously cast thin slabs, the casting machine or casting line 2 first begins with the production of the strand 22, that subsequently casting machine or casting line 3 begins with the production of strand 23 and the casting machine or casting line 1 begins last with the production of its strand 21.

Consequently, the first thin slab 25 is severed from strand 22 and is conveyed in the roller-bottom-type furnace 14 through the furnace zone 5, the equalizing zone 8 and the buffer zone 11.

Figure 2:
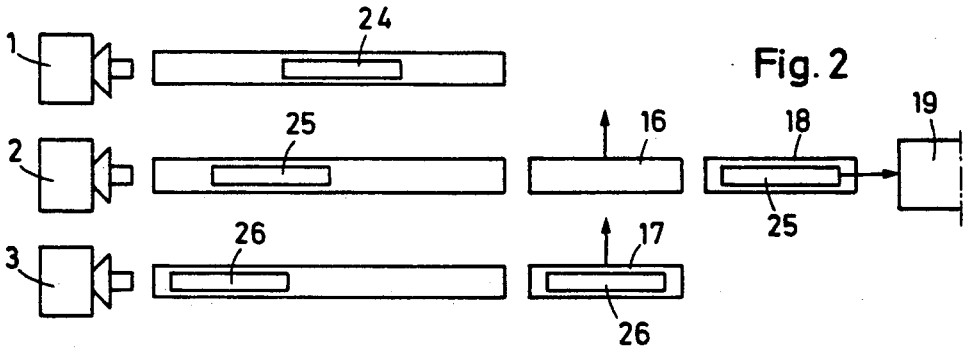
FIGS. 2–4 show the arrangement of FIG. 1 in different, successive phases of operation.

Since the casting machine or casting line 1 is the last to begin with the production of cast strand 21, the ferry 16 is moved from its initial position shown in FIG. 1 in transverse direction until it is in alignment with the roller-bottom-type furnace 14 and the receiving furnace 18, as illustrated in FIG. 2 of the drawing. The first thin slab 25 is then conveyed directly in longitudinal direction through the ferry 16 into the receiving furnace 18 and can subsequently be pulled into the hot-rolled wide strip finishing train 19 from the receiving furnace 18. Simultaneously with the movement of the thin slab 25 from the ferry 16 into the receiving furnace 18, a thin slab 26 is moved from the buffer zone 12 of the roller-bottom-type furnace 15 into the ferry 17 which has remained in the initial position, as shown in FIG. 2 of the drawing.

Figure 3:
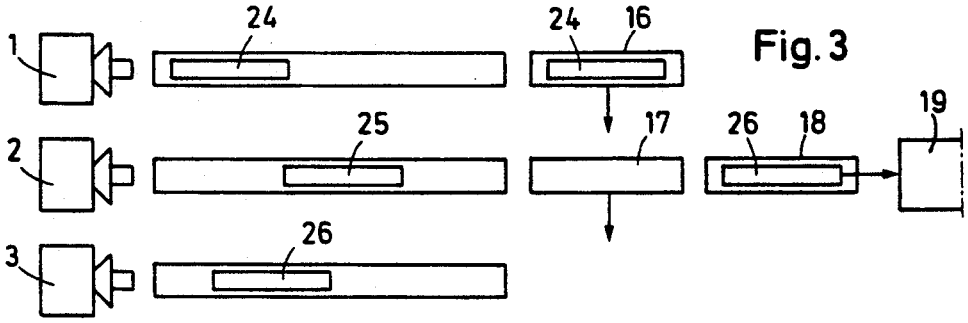
Figure 4:
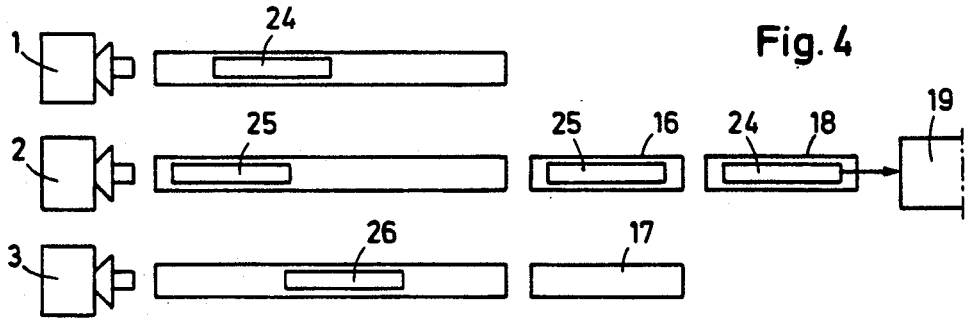

The two ferries 16 and 17 are now moved together or synchronously from the position of operation shown in FIG. 2 into the position of operation shown in FIG. 3. As a result, the ferry 16 is moved from the position in alignment with the roller-bottom-type furnace 14 into the position in alignment with the roller-bottom-type furnace 13, while the ferry 17 has been moved from the position in alignment with the roller-bottom-type furnace 15 into alignment with the subsequently arranged receiving furnace 18. When the thin slab 26 resting on ferry 17 is moved from ferry 17 into the receiving furnace 18, the thin slab 24 is simultaneously conveyed from the buffer zone 10 of the roller-bottom-type furnace 13 onto the ferry 16. Subsequently, the two ferries 16 and 17 are again moved transversely together or synchronously in the opposite direction, so that the ferry 17 returns empty into the position in alignment with the roller-bottom-type furnace 15, while the ferry 16 with the thin slab 24 reaches the position in alignment with the receiving furnace 18, so that the thin slab 24 can enter the receiving furnace 18, while simultaneously the ferry 16 reoeives the next thin slab 25. Ferry 17 remains empty. Both ferries 16 and 17 remain in their positions during the duration of a rolling cycle. Subsequently, the thin slab 25 is conveyed into the receiving furnace 18 and the thin slab 26 is moved onto ferry 17.

After the thin slab 26 has been moved onto ferry 17, both ferries 16 and 17 are again moved synchronously or together into the position shown in FIG. 3.

When operating the entire arrangement, it is important that the time for loading the thin slabs 24, 25, 26 from the buffer zones 10, 11, 12 of the roller-bottom-type furnaces 13, 14, 15 corresponds to the unloading time required for moving the individual thin slabs 24, 25, 26 from the ferries 16 or 17 into the receiving furnace 18.

However, it is equally important that the speed is selected such that the rolling time for each thin slab 24, 25, 26 in the hot-rolled wide strip finishing train 19 always exceeds the period of time which is required for the loading or unloading time of the ferries 16 or 17 and the travel time for transversely conveying the thin slabs 24, 25, 26.

The stationary roller-bottom-type furnaces 13, 14, 15 and the stationary receiving furnace 18 as well as the two longitudinal/transverse/longitudinal conveying systems operating as ferries 16 and 17 are heatable. Preferably, the conveying systems are roller-bottom-type furnaces which are displaceable in transverse direction, so that the furnace rollers can be used for the longitudinal transport of the individual thin slabs 24, 25, 26.

In contrast to the manner of operation discussed above with respect to FIGS. 1–4, the two ferries 16 and 17 may also maintain their positions as necessary or may travel to a complementary strand combination. The decisive factor is always from which of the continuously cast strands 21, 22, 23 a thin slab 24, 25, 26 can be expected at the earliest. All cast strands 21, 22, 23 can be equally treated by the combination of the two ferries 16 and 17.

Depending on the entry speed of the hot-rolled wide strip finishing train 19, the sequence periods of the thin slabs 24, 25, 26 can either be made uniform or can be operated in a defined manner and symmetrically for obtaining buffer periods for carrying out roll exchange operations. Of course, for this purpose, all longitudinal conveying means which are operated between the casting machines or casting lines 1, 2, 3 and the hot-rolled wide strip finishing train 19, must be controllable with respect to their conveying speeds within limits which are determined by the casting speed of the individual cast strands 21, 22, 23, on the one hand, and the entry speed of the hot-rolled wide strip finishing train 19, on the other hand.

While a specific embodiment of the invention has been shown and described in detail to illustrate the application of the inventive principle, it will be understood that the invention may be embodied otherwise without departing from such principles.

I claim:

1. An arrangement for rolling hot-rolled wide strips from continuously cast thin slabs by means of a continuous finishing train, the arrangement comprising a middle single-strand casting line and two outer single-strand casting lines which are arranged next to each other and in front of the finishing train, wherein the middle casting line is in alignment with the finishing train, means for severing individual thin slabs from each of three cast strands produced by the casting in a staggered sequence, two longitudinal/transverse/longitudinal conveying systems being arranged next to each other and following the casting lines and in front of the finishing train, means for placing each of the thin slabs severed from cast strands produced by the casting lines on one of the two longitudinal/transverse/longitudinal conveying systems, means for placing the two longitudinal/transverse/longitudinal conveying systems at a distance next to each other which corresponds to the distance between two adjacent casting lines, means for moving the two longitudinal/transverse/longitudinal conveying systems synchronously together or coupled together transversely over a distance which places one of the two longitudinal/transverse/longitudinal conveying systems in alignment with the middle casting line and with the finishing train, means for conveying each thin slab to the finishing train from the longitudinal/transverse/longitudinal conveying system which is in alignment with the finishing train, and means for simultaneously conveying the thin slabs to be rolled subsequently onto the longitudinal/transverse/ longitudinal conveying system which is in alignment with one of the outer casting lines.

2. The arrangement according to claim 1, wherein for each casting line a furnace, an equalizing zone and a buffer zone are arranged in front of the longitudinal/-transverse/longitudinal conveying systems, and a receiving furnace is arranged following the longitudinal/-transverse/longitudinal conveying systems and in front of and in alignment with the finishing train.

3. The arrangement according to claim 1, wherein the longitudinal/transverse/longitudinal conveying systems are heatable ferries.

4. The arrangement according to claim 3, wherein the ferries are furnaces which are-transversely movable and include a longitudinal conveying means.

5. The arrangement according to claim 4, wherein the furnaces are roller-bottom-type furnaces.

6. The arrangement according to claim 5, wherein each roller-bottom-type furnace is stationary and includes a furnace zone, an equalizing zone and a buffer zone.

* * * * *